US005355786A

United States Patent [19]

Tipton et al.

[11] Patent Number: 5,355,786

[45] Date of Patent: Oct. 18, 1994

[54] STRAP GUIDE FOR GUIDING STRAP THROUGH ALIGNED OPENINGS IN PALLET STRINGERS

[75] Inventors: Allison D. Tipton, Bloomingdale; Margaret Fialko, Glenview, both of Ill.

[73] Assignee: Signode Corporation, Glenview, Ill.

[21] Appl. No.: 123,992

[22] Filed: Sep. 21, 1993

[51] Int. Cl.[5] ..... B65B 13/04

[52] U.S. Cl. ..... 100/25; 53/589

[58] Field of Search ..... 100/8, 25, 26; 53/390, 53/589

[56] References Cited

U.S. PATENT DOCUMENTS

| | | | |
|---|---|---|---|
| 2,985,098 | 5/1961 | Winkler | 100/25 |
| 3,052,178 | 9/1962 | Hall | 100/25 |
| 3,150,585 | 9/1964 | Sterner | 100/25 |
| 3,152,539 | 10/1964 | Sorensen | 100/8 |
| 3,182,586 | 5/1965 | Armington et al. | 100/25 X |
| 3,213,781 | 10/1965 | Collins et al. | 100/25 X |
| 3,263,599 | 8/1966 | Dickens | 100/25 X |
| 3,279,354 | 10/1966 | Dickens et al. | 100/25 X |
| 3,376,807 | 4/1968 | Sterner | 100/26 |
| 3,899,963 | 8/1975 | Tremper | 100/25 |

FOREIGN PATENT DOCUMENTS

| | | | |
|---|---|---|---|
| 0446736 | 9/1991 | European Pat. Off. | 100/8 |
| 2486910 | 1/1982 | France | 100/8 |
| 1421621 | 9/1988 | U.S.S.R. | 100/8 |
| 1567450 | 5/1990 | U.S.S.R. | 100/8 |

*Primary Examiner*—Stephen F. Gerrity
*Attorney, Agent, or Firm*—T. W. Buckman; D. J. Breh

[57] ABSTRACT

A strap-guiding mechanism is disclosed for guiding a strap through aligned openings in spaced stringers of a shipping pallet. A supporting beam defines a longitudinal track, along which a carriage is arranged to be longitudinally moved. An elongate channel is supported by the carriage, from the proximal end of the channel, as a cantilever. The channel has a base and two upstanding sides. Each side has an upper, generally tubular portion defining an axis. Two tensioning members are employed, preferably steel bars. Each member extends through the generally tubular portion of the upper side of the channel and is tensioned so as to impart axial compression to the generally tubular portion thereof, and so to counteract tendencies of the distal end of the channel to be downwardly deflected by gravity when the channel is supported as a cantilever. A motor is arranged to drive the carriage along the track via a chain and sprocket drive. Two longitudinal series of strap gates in side-by-side relation are employed. Each strap gate includes an elongate cover mounted to one side of the channel so as to be pivotably movable between a strap-guiding position and a range of strap-releasing positions. Each strap gate is biased to the strap-guiding position.

12 Claims, 3 Drawing Sheets

Fig. 1
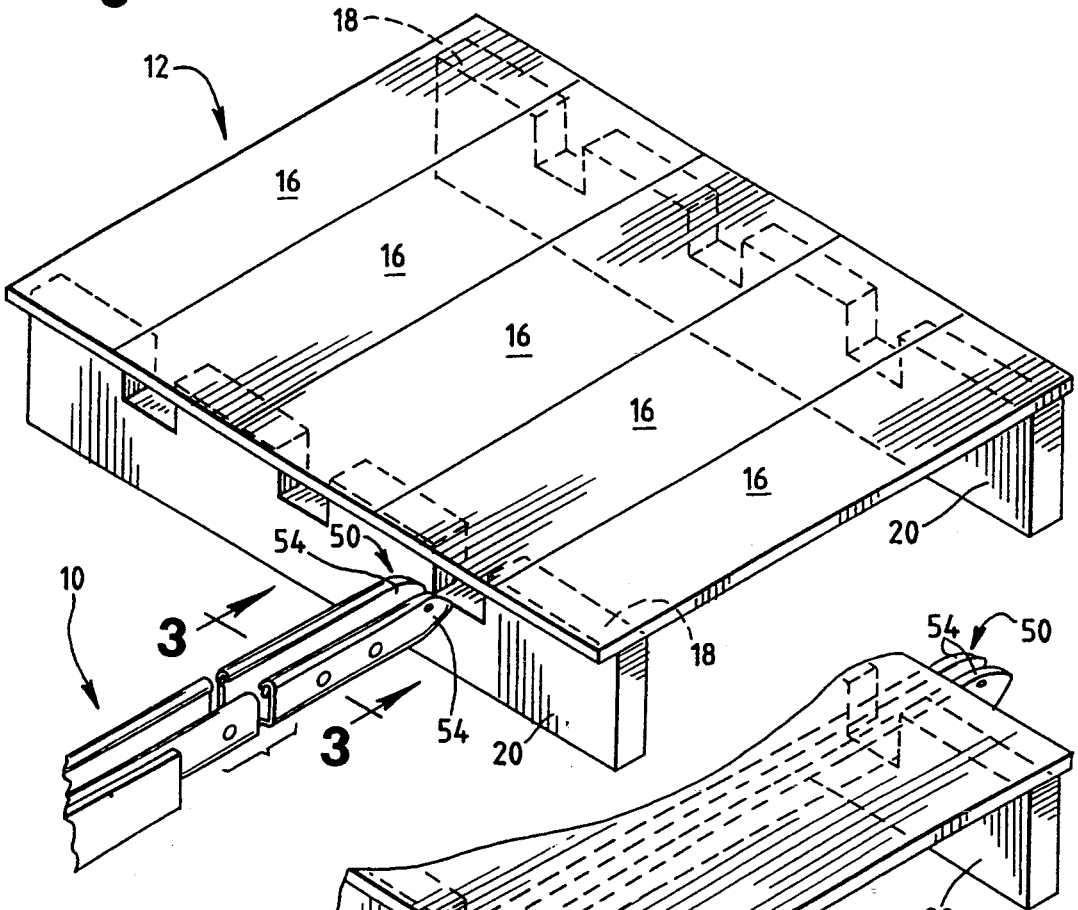
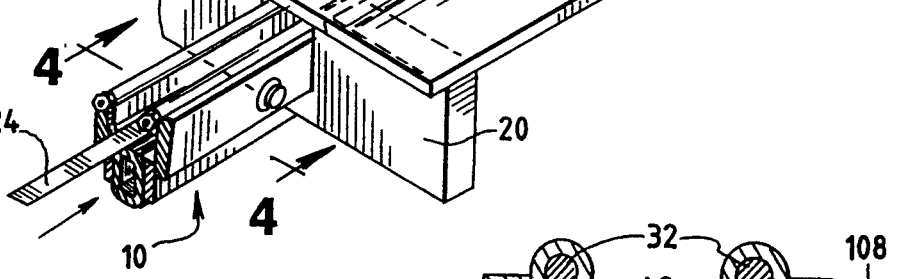
Fig. 2
Fig. 3
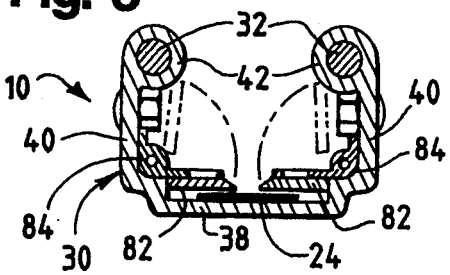
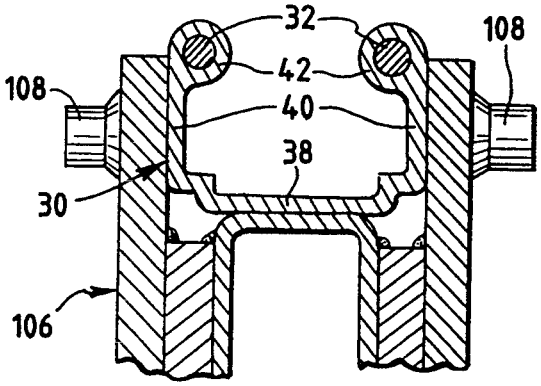
Fig. 4

STRAP GUIDE FOR GUIDING STRAP THROUGH ALIGNED OPENINGS IN PALLET STRINGERS

TECHNICAL FIELD OF THE INVENTION

This invention pertains to an improved strap guide of a type used for guiding a strap through aligned openings in spaced stringers of a shipping pallet, so that the strap can be then fed around a load supported by the pallet, tensioned, and sealed so as to integrate the pallet and the load. Because such a strap guide may be advantageously employed as an attachment to an automated strapping system, such a strap guide may be also called a pallet void feeder attachment or PVFA. Further, such a strap guide may be also known as a bayonet guide.

BACKGROUND OF THE INVENTION

As known heretofore, a strap guide of the type noted above comprises an elongate channel, which is supported from a proximal end as a cantilever as the strap guide is directed through aligned openings in spaced stringers of a shipping pallet. It is known to direct such a strap guide manually. It also is known to direct such a strap guide via an automated mechanism.

In certain industries including the fine paper industry, shipping pallets (or skids) having very small openings (e.g. about 1.5 inches in width and about 1.25 inches in height) are employed. Such small openings may be widely spaced (e.g. by about four to eight feet) in such a pallet.

Because the opposite or distal end of a strap guide of the type noted above tends to be downwardly deflected by gravity as the strap guide is supported from the proximal end as a cantilever, it can be very difficult to direct the strap guide through such small, widely spaced openings in spaced stringers of a shipping pallet, whether manually or via an automated mechanism.

Generally, as known heretofore, strap guides of the type noted above cannot be effectively employed with shipping pallets having spaced stringers with such small, widely spaced openings. Hence, there has been a need, to which this invention is addressed, for an improved strap guide that can be effectively employed with a shipping pallet having spaced stringers with such small, widely spaced openings.

SUMMARY OF THE INVENTION

This invention provides an improved strap guide for guiding a strap through aligned openings in spaced stringers of a shipping pallet. The improved strap guide can be effectively used with a shipping pallet having spaced stringers with very small, widely spaced openings, as discussed above.

Broadly, the improved strap guide comprises an elongate channel, preferably an aluminum extrusion, and a tensioning member, preferably a steel rod.

The channel has a proximal end and a distal end and is supportable from the proximal end as a cantilever. The channel has a base and two sides upstanding from the base. At least one side has an upper, generally tubular portion defining an axis. The tensioning member extends through the generally tubular portion and is tensioned so as to impart axial compression to the generally tubular portion, and so as to counteract tendencies of the distal end of the channel to deflect downwardly when the channel is supported from the proximal end as a cantilever.

Preferably, each side has an upper, tubular portion defining an axis. Preferably, moreover, two tensioning members are employed, each extending through the generally tubular portion of one side of the channel and being tensioned so as to impart axial compression to the generally tubular portion thereof, and so as to counteract tendencies of the distal end of the channel to deflect downwardly when the channel is supported from the proximal end as a cantilever.

Preferably, the strap guide comprises two strap gates in side-by-side relation, more preferably two longitudinal series of strap gates in side-by-side relation. Each strap gate includes an elongate cover mounted to one of the sides so as to be pivotably movable between a strap-guiding position and a range of strap-releasing positions. In the strap-guiding position, the cover of each strap gate is generally parallel to the base of the channel. In the strap-releasing positions, the cover of each strap gate is pivoted from the strap-guiding position. The cover of each strap gate is biased to the strap-guiding position.

The improved strap guide may be advantageously combined with a supporting beam and a carriage in a strap-guiding mechanism, in which the supporting beam has a longitudinal track, along which the carriage is arranged to be longitudinally moved. Preferably, the strap-guiding mechanism is provided with means including a motor for driving the carriage along the track.

These and other objects, features, and advantages of this invention are evident from the following description of a preferred embodiment of this invention with reference to the accompanying drawings.

BRIEF DESCRIPTION OF THE DRAWINGS

FIG. 1 is a perspective view of a shipping pallet having upper decking boards and two spaced stringers with aligned openings, through which a steel or polymeric strap is fed, along with a strap guide embodying this invention. The strap guide is shown fragmentarily in a position wherein it is about to enter such an opening in a nearer stringer.

FIG. 2 is a fragmentary, perspective view of the shipping pallet and the strap guide, which is shown as extending through aligned openings in the nearer stringer and a farther stringer. A strap is shown as being guided by the strap guide.

FIG. 3, on a larger scale, is a sectional view taken along line 3—3 of FIG. 1, in a direction indicated by arrows.

FIG. 4, on a similar scale, is a sectional view taken along line 4—4 of FIG. 2, in a direction indicated by arrows. The strap shown in FIG. 2 is omitted in FIG. 4.

DETAILED DESCRIPTION OF PREFERRED EMBODIMENT

Figure 6:
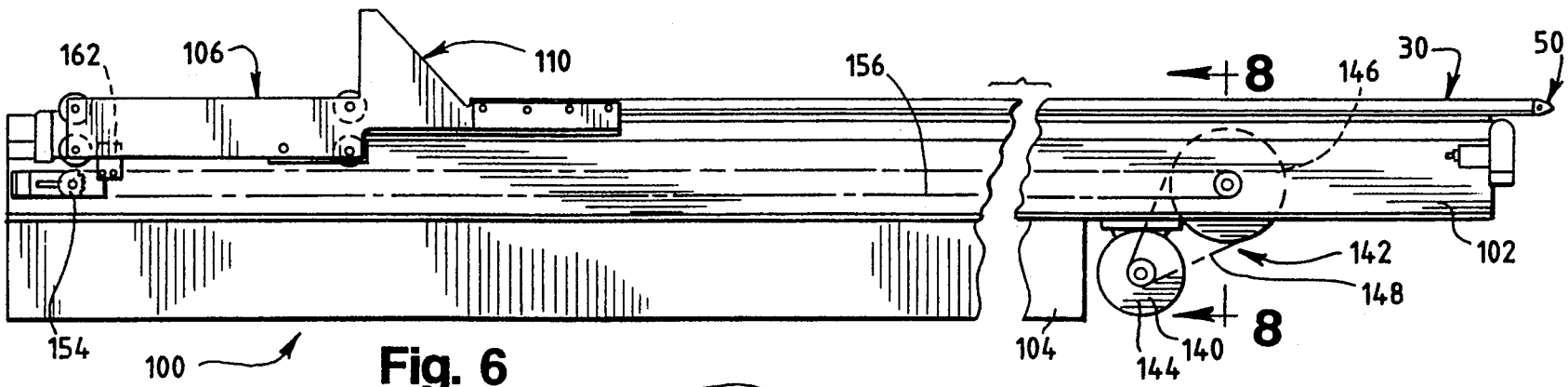
FIG. 6, on the scale of FIGS. 1 and 2, is a shortened, elevational view of a strap-guiding mechanism including the strap guide, a carriage mounting the strap guide, and a supporting beam defining a longitudinal track, along which the carriage and the strap guide are movable, along with a motor for driving the carriage and the strap guide along the track.
Figure 7:
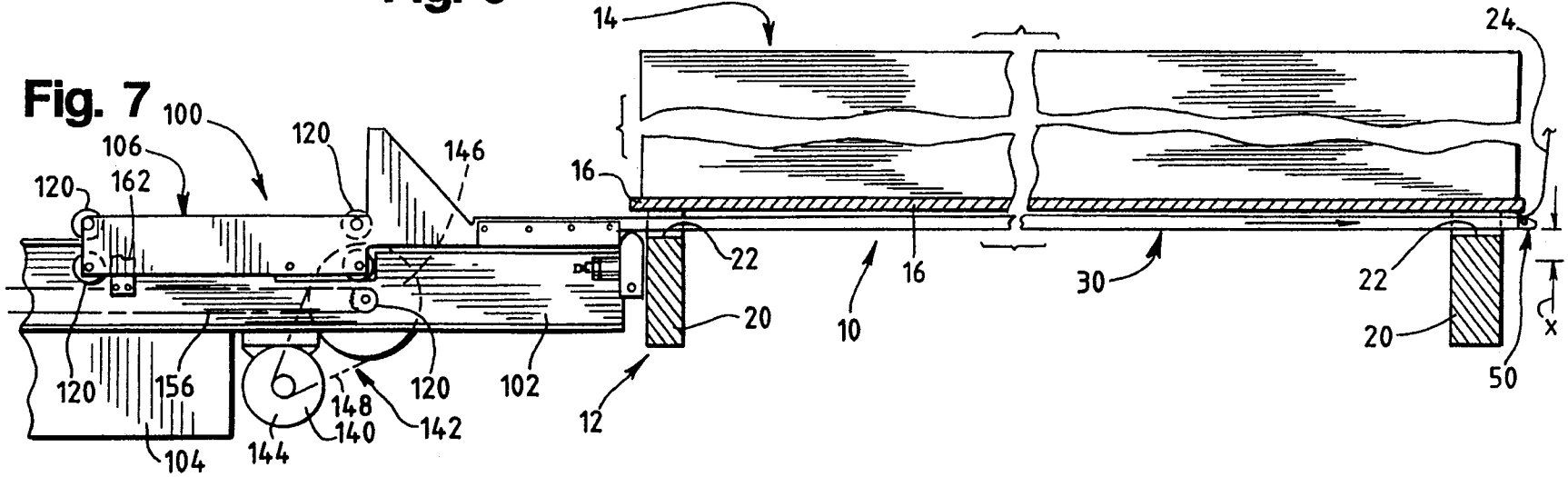
FIG. 7 is a fragmentary, elevational view of the strap-guiding mechanism, as used to direct the strap guide through aligned openings in the spaced stringers of the aforenoted pallet, which is shown in cross-section as supporting a load.

As shown in the drawings, a strap guide 10 constitutes a preferred embodiment of this invention. The strap guide 10 is useful with a shipping pallet 12 supporting a load 14 (see FIG. 6) on flat decking boards 16 secured, as by nailing, to the upper edges 18 of two spaced stringers 20 having aligned openings 22 where the upper edges 18 of the spaced stringers 20 meet the decking boards 16. Each stringer 20 has three such openings 22, each being aligned with such an opening 22 in the other stringer 20. The strap guide 10 is useful for guiding a steel or polymeric strap 24 through one such opening 22 in one stringer 20 and through the aligned opening 22 in the other stringer 20, so that the strap 24 can be then fed around the load 14, tensioned, and sealed by a strapping head (not shown) so as to integrate the pallet 12 and the load 14.

As shown in FIGS. 1 through 4 and other views, the strap guide 10 comprises an elongate channel 30, preferably an aluminum extrusion, and two tensioning members 32, preferably steel rods. The channel 30 has a proximal end 34 and a distal end 36 and is supportable from the proximal end 36 as a cantilever in a manner to be later described. The channel 30 is extruded so as to have a base 38 and two sides 40 upstanding from the base 38 with each side 40 having an upper, generally tubular portion 42, which defines an axis. Each tensioning member 32 extends through the tubular portion 42 of a respective one of the sides 40 and is tensioned so as to impart axial compression to the generally tubular portion 42 thereof, and so as to counteract tendencies of the channel 30 to deflect downwardly when the channel 30 is supported from the proximal end 36 as a cantilever. Each tensioning member 32 has two threaded ends, namely a proximal end 44 and a distal end 46.

Figure 5:
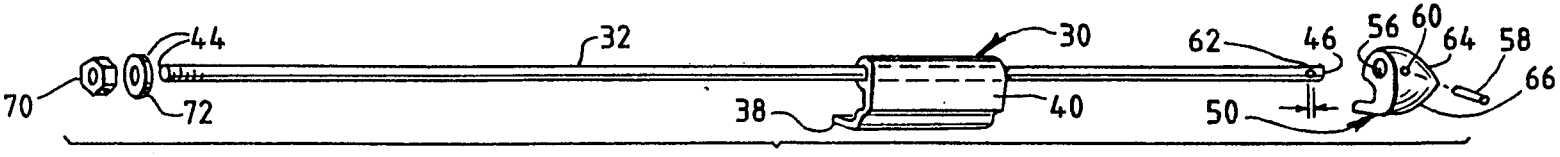
FIG. 5 is a fragmentary, exploded view of certain elements on one side of the strap guide, namely an elongate channel, a tensioning rod, and a nosepiece, along with a threaded nut and an associated washer.

As shown in FIG. 5 and other views, a nosepiece 50 is mounted at the distal end 36 of the channel 30. The nosepiece 50 has a base 52 abutting the base 38 of the channel 30 at the distal end 36 thereof and two sides 54 upstanding from the base 52, each side 54 abutting one side 40 of the channel 30 at the distal end thereof. Each side 54 of the nosepiece 50 has a threaded socket 56 receiving the threaded, distal end 46 of one tensioning member 32. Cross pins 58 extending through aligned holes 60 in the sides 54 and through aligned holes 62 in the such ends 46 further secure such ends 46 in the sockets 56. Such sides 54 have beveled upper surfaces 64 and beveled lower surfaces 66, as shown in FIG. 5 and other views, so as to facilitate inserting such ends 54 through the openings 222 in the stringers 20 of the pallet 12.

As shown in FIG. 5 and other views, a threaded nut 70 is threaded onto the threaded, proximal ends 44 of each tensioning member 32, over an annular washer 72, and tightened so as to tension such tensioning member 32. Thus, each tensioning member 32 is tensioned so as to impart axial compression to its generally tubular portion 42, and so as to counteract tendencies of the distal end 36 of the channel 30 to deflect downwardly when the channel 30 is supported from its proximal end 34 as a cantilever.

Figure 9:
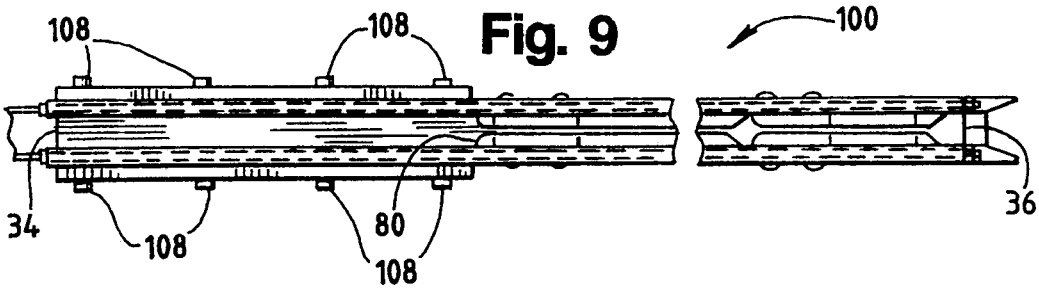
FIG. 9, on a larger scale, is a fragmentary, plan view of the strap guide and the carriage.

As shown in FIGS. 3 and 9, the strap guide 10 comprises two longitudinal series of strap gates 80. Each strap gate 80 includes an elongate cover 82 made from a metal strip. The cover 82 of each strap gate 80 is mounted to one of the sides 40 of the channel 30, via a hinge 84, so as to be pivotable movable between a strap-guiding position and a range of strap-releasing positions. In FIG. 3, the strap gates 82 are shown in full lines in the strap-guiding position, in which each cover 82 is generally parallel to the base 38 of the channel 30. The channel 30 is extruded so as to have two longitudinal shoulders (not shown), which limit pivoting of the covers 82 to the strap-guiding position. In FIG. 3, the strap gates 82 are shown in broken lines at a limiting position in the range of strap-releasing positions, in which each cover 82 is pivoted from the strap-guiding position of such cover 82. The cover 82 of each strap gate 80 is biased gravitationally or by a spring (not shown) to the strap-guiding position.

Figure 10:
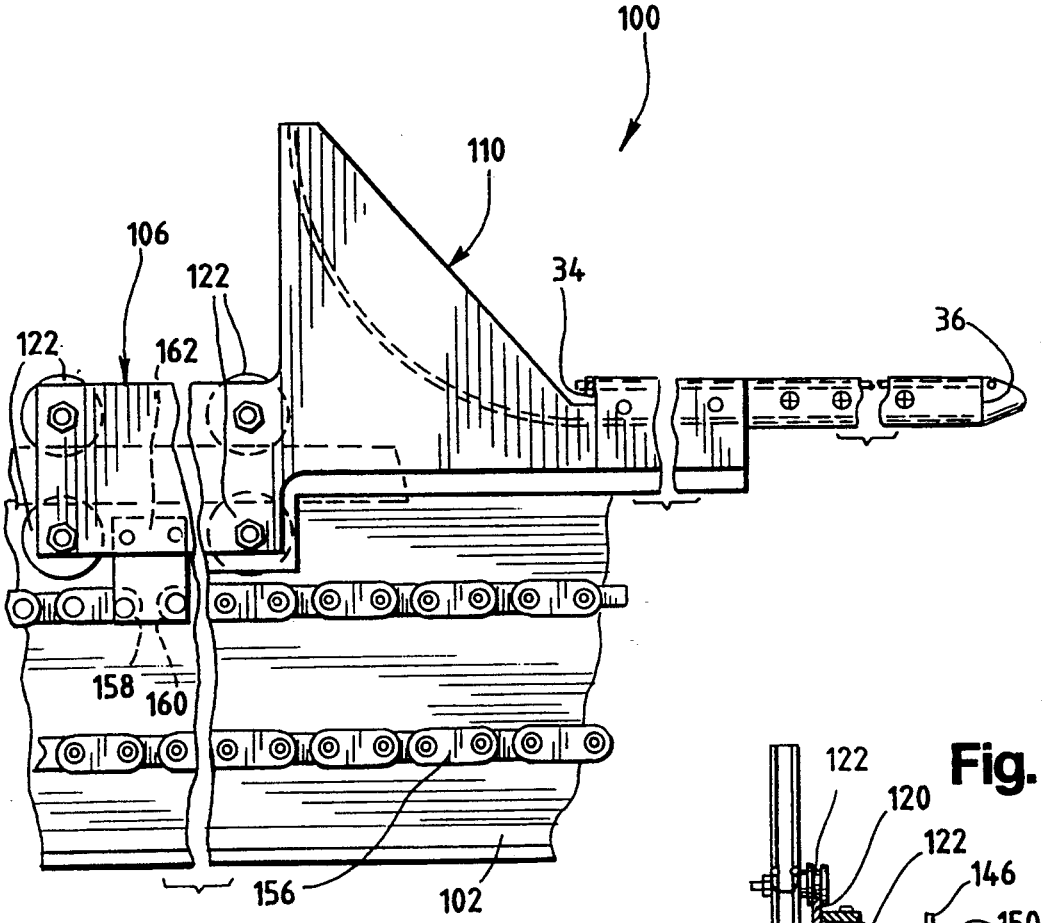
FIG. 10, on a similar scale, is a fragmentary, elevational view of the strap guide, the carriage, and the supporting beam.

As shown in FIGS. 6 through 10, a strap-guiding mechanism 100 useful as an attachment to an automated strapping system (not shown otherwise) combines the strap guide 10 with a supporting beam 102 on a base 104 (FIG. 7) elevating the supporting beam 102 and the shipping pallet 12 above a floor (not shown) and with a carriage 106, which is mounted fixedly to the strap guide 10 via fasteners 108 so as to support the channel 30 from its proximal end 34 as a cantilever. The carriage 104 is fabricated so as to define a corner guide 110, which is positioned so as to merge with the strap guide 10. As shown in FIG. 10 and other views, the corner guide 110 is curved so as to permit the strap 24 noted above to be horizontally fed through the strap guide 10.

Figure 8:
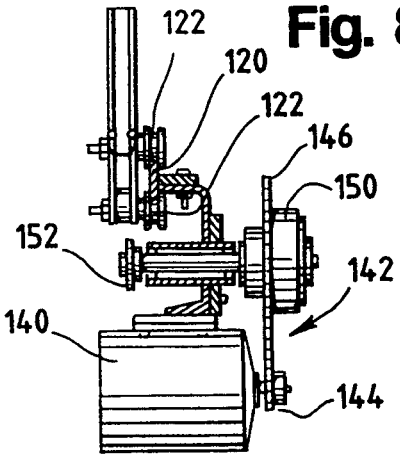
FIG. 8 is a sectional view taken along line 8—8 of FIG. 6, in a direction indicated by arrows.

The supporting beam 102 mounts a longitudinally extending track 120 made from a steel bar of rectangular cross-section. The carriage 104 has grooved wheels 120, which are arranged in two longitudinally spaced pairs so as to be longitudinally movable along the track 120. As shown in FIG. 8 and other views, two wheels 122 are arranged to ride along an upper, narrow edge of the track 120, and two wheels 122 are arranged to ride along a lower, narrow edge of the track 120.

An electrically driven motor 140, which is mounted beneath the supporting beam 102, is arranged to drive the carriage 106 along the track 120, between the proximal end 122 and the distal end 124. The motor 140 is arranged to drive the carriage 106 via a sprocket and chain drive 142 comprising a small sprocket 144 arranged to be rotatable driven by the motor 140, a large sprocket 146 journalled to the supporting beam 102 and arranged to be conjointly driven via an endless chain 148, a clutch 150 arranged to be rotatably driven by the sprocket 144, a small sprocket 152 arranged to be rotatably driven by the sprocket 146 via the clutch 150, a small sprocket 154 (FIG. 6) spaced longitudinally from the sprocket 152, journalled to the supporting beam 102, and arranged to be conjointly driven via a coacting chain 156 connected at its opposite ends 158, 160, to the carriage 106 via a link 162. The chain 148 is shown diagrammatically in FIGS. 6 and 7 but is omitted in FIG. 8. The chain 156 is shown in full lines in FIG. 10 and diagrammatically in FIGS. 6 and 7 but is omitted in FIG. 10. The clutch 150 is arranged to overrun if and when the bumper 170 reaches the shipping pallet 12 so as to prevent damage to the strap-guiding mechanism 100.

In an automated strapping system, the strap guide 10 may be one of a pair of similar strap guides for coacting with the outer openings 22 of the stringers 20. Moreover, the pallet 12 may be advantageously supported on a turntable (not shown) which enables the pallet 12 and the load 14 to be cross-strapped without relocating the pair of similar strap guides.

Various modifications may be made in the preferred embodiment described above without departing from the scope and spirit of this invention.

We claim:

1. A strap guide for guiding a strap through aligned openings in spaced stringers of a shipping pallet, the strap guide comprising (a) an elongate channel having a proximal end and a distal end and being supportable from the proximal end as a cantilever, the channel having a base and two sides upstanding from the base, at least one side having an upper, generally tubular portion defining an axis, and (b) a tensioning member extending through the generally tubular portion and being tensioned so as to impart axial compression to the generally tubular portion, and so to counteract tendencies of the distal end of the channel to be downwardly deflected by gravity when the channel is supported from the proximal end as a cantilever.

2. The strap guide of claim 1 wherein the tensioning member is a steel rod.

3. The strap guide of claim 1 wherein the elongate channel is an aluminum extrusion.

4. A strap guide for guiding a strap through aligned openings in spaced stringers of a shipping pallet, the strap guide comprising (a) an elongate channel having a proximal end and a distal end and being supportable from the proximal end as a cantilever, the channel having a base and two sides upstanding from the base, each side having an upper, generally tubular portion defining an axis, and (b) two tensioning members, each extending through the generally tubular portion of one side of the channel and being tensioned so as to impart axial compression to the generally tubular portion thereof, and so to counteract tendencies of the distal end of the channel to be downwardly deflected by gravity when the channel is supported from the proximal end as a cantilever.

5. The strap guide of claim 4 further comprising at least one strap gate including an elongate cover mounted to one of the sides so as to be pivotably movable between a strap-guiding position wherein the cover is generally parallel to the base of the channel and a range of strap-releasing positions wherein the cover is pivoted away from the strap-guiding position, the cover being biased to the strap-guiding position.

6. The strap guide of claim 4 further comprising two strap gates in side-by-side relation, each strap gate including an elongate cover mounted to one of the sides so as to be pivotably movable between a strap-guiding position wherein the cover is generally parallel to the base of the channel and a range of strap-releasing positions wherein the cover is pivoted away from the strap-guiding position, the cover being biased to the strap-guiding position.

7. The strap guide of claim 6 wherein each tensioning member is a steel rod and the elongate channel is an aluminum extrusion.

8. A strap-guiding mechanism for guiding a strap through aligned openings in spaced stringers of a shipping pallet, the mechanism comprising (a) a supporting beam having a longitudinal track with a proximal end and a distal end, (b) a carriage arranged to be longitudinally moved along the track, and (c) a strap guide comprising (1) an elongate channel having a proximal end and a distal end, the channel being supported by the carriage, from the proximal end of the channel, the channel being supported thereby as a cantilever at least when the carriage is moved so that the distal end-of the channel extends beyond the supporting beam, the channel having a base and two sides upstanding from the base, at least one side having an upper, generally tubular portion defining an axis, and (2) a tensioning member extending through the generally tubular portion and being tensioned so as to impart axial compression to the generally tubular portion, and so to counteract tendencies of the distal end of the channel to be downwardly deflected by gravity when the channel is supported by the carriage, from the proximal end of the channel, as a cantilever.

9. The strap-guiding mechanism of claim 8 further comprising means including a motor for driving the carriage along the track, between the proximal and distal ends of the track.

10. The strap-guiding mechanism of claim 8 wherein the strap guide further comprises at least one strap gate including an elongate cover mounted to one of the sides so as to be pivotably movable between a strap-guiding position wherein the cover is generally parallel to the base of the channel and a range of strap-releasing positions wherein the cover is pivoted away from the strap-guiding position, the cover being biased to the strap-guiding position.

11. A strap-guiding mechanism for guiding a strap through aligned openings in spaced stringers of a shipping pallet, the mechanism comprising (a) a supporting beam defining a longitudinal track having a proximal end and a distal end, (b) a carriage arranged to be longitudinally moved along the track, between the proximal and distal ends of the track, (c) means including a motor for driving the carriage along the track, between the proximal and distal ends of the track, and (d) a strap guide comprising (1) an elongate channel having a proximal end and a distal end, the channel being supported by the carriage, from the proximal end of the channel, the channel being supported thereby as a cantilever at least when the carriage is moved so that the distal end of the channel extends beyond the supporting beam, the channel having a base and two sides upstanding from the base, each side having an upper, generally tubular portion defining an axis, (2) two longitudinal series of strap gates in side-by-side relation, each strap gate including an elongate cover mounted to one of the sides so as to be pivotably movable between a strap-guiding position wherein the cover is generally parallel to the base of the channel and a range of strap-releasing positions wherein the cover is pivoted away from the strap-guiding position, the cover being biased to the strap-guiding position, and (3) two tensioning members, each extending through the generally tubular portion of one side of the channel and being tensioned so as to impart axial compression to the generally tubular portion thereof, and so to counteract tendencies of the distal end of the channel to be downwardly deflected by gravity when the channel is supported by the carriage, from the proximal end of the channel, as a cantilever.

12. The strap guide of claim 11 wherein each tensioning member is a steel rod and the elongate channel is an aluminum extrusion.

* * * * *